US009830793B2

(12) United States Patent
Padula

(10) Patent No.: US 9,830,793 B2
(45) Date of Patent: Nov. 28, 2017

(54) AUTOMATIC SELECTIVE DAMPING OF A RESONANT ANTENNA

(71) Applicant: Guillermo H. Padula, Boca Raton, FL (US)

(72) Inventor: Guillermo H. Padula, Boca Raton, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 580 days.

(21) Appl. No.: 14/485,946

(22) Filed: Sep. 15, 2014

(65) Prior Publication Data

US 2016/0019766 A1 Jan. 21, 2016

Related U.S. Application Data

(60) Provisional application No. 62/025,057, filed on Jul. 16, 2004.

(51) Int. Cl.
*G08B 13/14* (2006.01)
*G08B 13/24* (2006.01)

(52) U.S. Cl.
CPC ..... *G08B 13/2468* (2013.01); *G08B 13/2477* (2013.01)

(58) Field of Classification Search
CPC ..... G08B 1/00; A61B 1/00
See application file for complete search history.

(56) References Cited

U.S. PATENT DOCUMENTS

| | | | | |
|---|---|---|---|---|
| 4,510,489 | A | 4/1985 | Anderson, III et al. | |
| 4,510,490 | A | 4/1985 | Anderson, III et al. | |
| 5,257,010 | A | 10/1993 | Rehder | |
| 5,815,076 | A * | 9/1998 | Herring | G08B 13/2431 340/572.5 |
| 2009/0189741 | A1 * | 7/2009 | Rowland | A61B 5/0031 340/10.4 |
| 2011/0095889 | A1 | 4/2011 | Yang et al. | |
| 2013/0278426 | A1 * | 10/2013 | Sayegh | G08B 13/246 340/572.3 |

* cited by examiner

*Primary Examiner* — Shirley Lu
(74) *Attorney, Agent, or Firm* — Fox Rothschild LLP; Robert J. Sacco; Carol E. Thorstad-Forsyth

(57) ABSTRACT

A damping control system disposed at a location of an antenna resonant circuit detects an exciter signal produced by a remotely located EAS transmitter. The damping control system generates a switch control signal in response to the detection of an EAS exciter signal burst. The switch control signal is used to reduce a Q factor of the antenna resonant circuit by selectively controlling at least one switching element connected to the antenna resonant circuit. The damping control system controls a timing of the switch control signal so as to reduce the Q factor at a predetermined time selected to reduce ringing at a trailing edge of each periodic burst.

15 Claims, 8 Drawing Sheets

AUTOMATIC SELECTIVE DAMPING OF A RESONANT ANTENNA

CROSS REFERENCE TO RELATED APPLICATIONS

This application is a non-provisional application of U.S. Provisional Application No. 62/025,057 filed on Jul. 16, 2014, which is herein incorporated in its entirety.

BACKGROUND OF THE INVENTION

Statement of the Technical Field

The invention relates generally to Electronic Article Surveillance ("EAS") systems, and more particularly to improvements in EAS tag detection performance.

Description of the Related Art

EAS systems use EAS transmitters to excite markers or tags which are present in a detection zone. The transmitter periodically generates a burst of electromagnetic energy at a particular frequency to excite the EAS tag. When a marker tag is excited in the detection zone during the time of the burst, the marker tag will generate an electromagnetic signal which can usually be detected by a receiver. One type of EAS system utilizes acousto-magnetic (AM) markers. The general operation of an AM type EAS system is described in U.S. Pat. Nos. 4,510,489 and 4,510,490. As is known, the transmitter or exciter in many common AM type EAS systems will transmit bursts or pulses of electromagnetic energy at 58 kHz and then listen for a response from an EAS tag that is present in a detection zone.

SUMMARY OF THE INVENTION

The invention concerns an Electronic Article Surveillance (EAS) resonant antenna system with self-contained automatic selective damping. An antenna resonant circuit is responsive to an exciter signal produced by a remotely located EAS transceiver. The exciter signal is comprised of a periodic burst of alternating current (AC) electrical energy which, when applied to the antenna resonant circuit, produces an electromagnetic field which is capable of exciting an EAS marker tag. A damping control system is provided at the location of the antenna resonant circuit, remote from the EAS transceiver. The damping control system detects each periodic burst received at the antenna resonant circuit, and is responsive to the detecting to selectively decrease a Q factor of the antenna resonant circuit at a predetermined time. Notably, the damping control system initiates a timing trigger signal for decreasing the Q factor based exclusively on the periodic burst received at the antenna resonant circuit, absent any other control signal from the EAS transceiver or other remote circuitry. The predetermined time is advantageously chosen to reduce ringing at a trailing edge of each burst of the exciter signal. The damping control system automatically restores the Q factor of the antenna resonant circuit to a higher Q factor value before a next periodic burst is received.

According to one aspect, the damping control system detects a beginning of each the periodic burst and in response thereto generates a switch control signal after a predetermined delay to selectively decrease the Q factor. For example, the predetermined delay can correspond to a predetermined duration of each periodic burst. Accordingly, the Q factor is reduced at a predetermined time corresponding to the end of each burst.

A power supply system is disposed at the location of the antenna resonant circuitry. The power supply system rectifies and filters electrical power contained in the periodic bursts to provide a primary source of electrical power to the damping control system. As such, the power supply system is connected to receive at least a portion of the exciter signal from the remotely located EAS transceiver. The power supply is coupled to at least one component of the damping control system.

The invention also concerns an Electronic Article Surveillance (EAS) system. The EAS system includes an EAS system controller, including an EAS transceiver, and a resonant antenna system as described above. The resonant antenna system is located remote from the EAS system controller and coupled to the EAS system controller through an antenna cable. The resonant antenna system includes a damping control system as described above.

The invention also concerns a method for selectively controlling a Q-factor of an antenna resonant circuit in an EAS system. The method involves using a damping control system disposed at a location of an antenna resonant circuit. The damping control system detects an exciter signal produced by a remotely located EAS transmitter. The exciter signal is comprised of periodic bursts of alternating current (AC) electrical energy which, when applied to the antenna resonant circuit, produce an electromagnetic field which is capable of exciting an EAS marker tag. The method further involves operating the damping control system to generate a switch control signal in response to the detecting, and using the switch control signal to reduce a Q factor of the antenna resonant circuit by controlling at least one switching element connected to the antenna resonant circuit. The damping control system controls a timing of the switch control signal so as to reduce the Q factor at a predetermined time selected to reduce ringing at a trailing edge of each periodic burst.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

In an EAS system, a resonant circuit used to radiate electromagnetic energy into a EAS detection zone will have a relatively high Q. Consequently, the burst of electrical energy used to excite the resonant circuit will not terminate instantaneously at the end of each burst, but will instead ring-down slowly over time. Extended ring-down periods are problematic because they interfere with the ability of an EAS receiver to detect marker tags in an EAS detection zone. To alleviate this problem, resistive loss can be selectively added to the resonant circuit, at the location of the antenna and remote from the burst source. The resistive loss is selectively added to the resonant circuit temporarily at the termination of each burst to increase damping and thereby reduce the Q of the resonant circuit. Reducing the Q in this way advantageously reduces the ring-down time and improves performance of the EAS. Improved ring-down control is obtained by adding resistive loss directly at the antenna as opposed to at the burst source (which may be located remotely from the antenna). Moreover, the improved automatic damping can be obtained without modifying a conventional existing EAS control system or the circuitry between the control system and a remotely located antenna. Accordingly, the improvements can easily be retrofit to existing EAS systems for improved performance at minimal cost.

Figure 1:
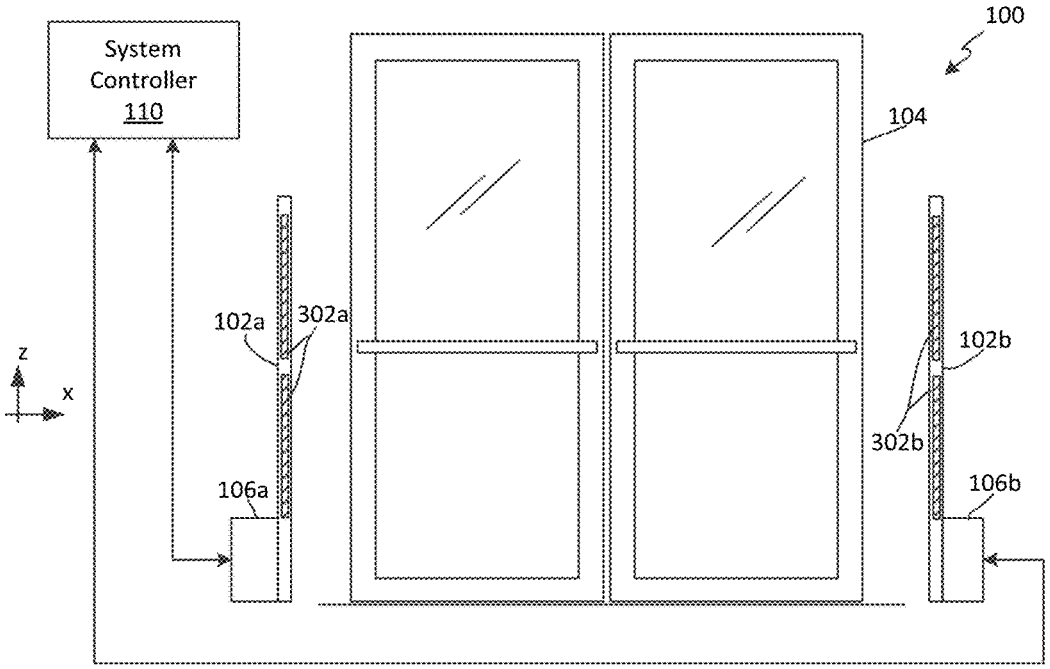
FIG. 1 is front view of an EAS system that is useful for understanding the invention.
Figure 2:
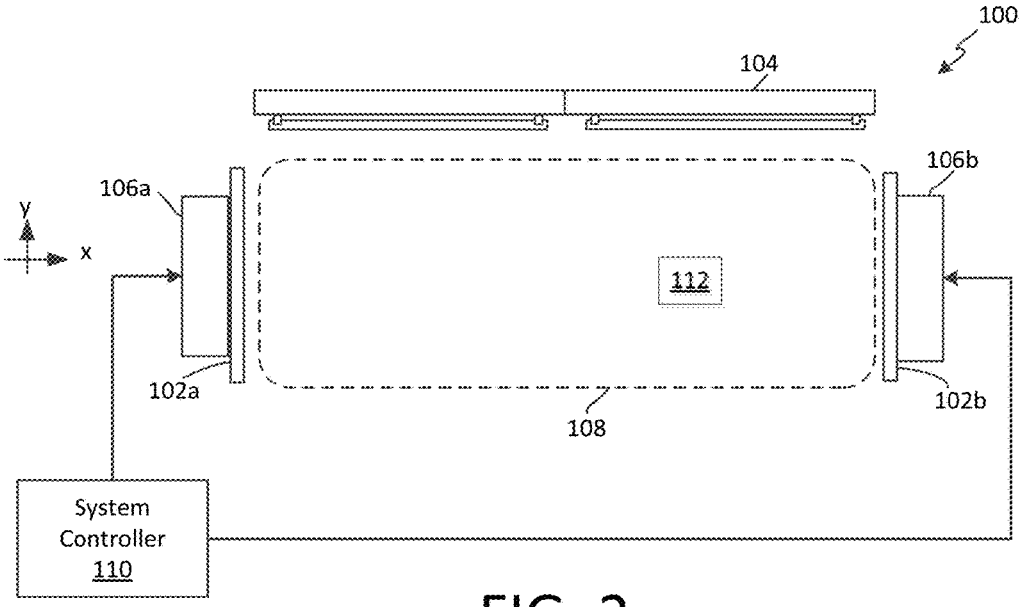
FIG. 2 is a top view of the EAS system in FIG. 1.
Figure 3:
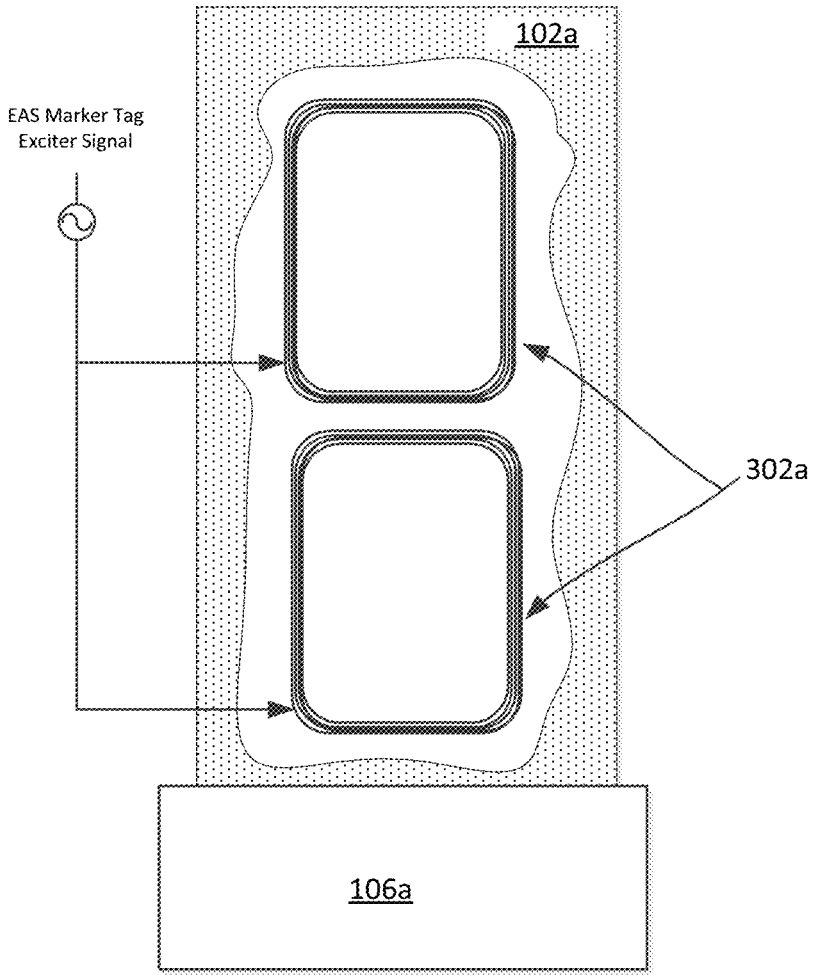
FIG. 3 is a partial cutaway view of an antenna pedestal that can be used in the EAS system in FIGS. 1 and 2

Referring now to the drawings figures in which like reference designators refer to like elements, there is shown in FIGS. 1-3 an exemplary EAS detection system 100. The EAS detection system will commonly be positioned at a location adjacent to an entry/exit 104 of a secured facility. The EAS system 100 uses specially designed EAS marker tags ("tags") which are applied to store merchandise or other items which are stored within a secured facility. The tags can be deactivated or removed by authorized personnel at the secure facility. For example, in a retail environment, the tags could be removed by store employees. When an active tag 112 is in an EAS detection zone 108 near the entry/exit, the EAS detection system will detect the presence of such tag and will sound an alarm or generate some other suitable EAS response. Accordingly, one use of the EAS detection system 100 is for detecting and preventing the unauthorized removal of articles or products from controlled areas.

A number of different types of EAS detection schemes are well known in the art. For example, known types of EAS detection schemes can include magnetic systems, acousto-magnetic systems, radio-frequency type systems and microwave systems. For purposes of describing the inventive arrangements, it shall be assumed that the EAS detection system 100 is an acousto-magnetic (AM) type system. Still, it should be understood that the invention is not limited in this regard and other types of EAS detection methods can also be used with the present invention.

An exemplary EAS detection system 100 includes a pair of pedestals 102*a*, 102*b*, which are located a known distance apart (e.g. at opposing sides of entry/exit 104). The pedestals 102*a*, 102*b* are typically stabilized and supported by a base 106*a*, 106*b*. Pedestals 102*a*, 102*b* will each generally include one or more antennas that are suitable for aiding in the detection of the special EAS tags as described herein. Other types of antenna arrangements are also possible. For example, one or more EAS antennas can be disposed in a wall, ceiling or floor adjacent to a detection zone. For convenience, the inventive arrangements will be described in relation to a pedestal type EAS configuration. Still, it should be understood that the invention is not limited in this regard and the arrangements described herein are applicable to any type of EAS system where it is desirable to control a damping of a resonant antenna.

An EAS pedestal 102*a* can include at least one antenna 302*a* that is suitable for transmitting or producing an electromagnetic exciter signal field and receiving response signals generated by marker tags in the detection zone 108. In some embodiments, the same antenna can be used for both receive and transmit functions. However, a pedestal 102*b* can include at least a second antenna 302*b*. The second antenna can be suitable for transmitting or producing an electromagnetic exciter signal field and/or receiving response signals generated by marker tags in the detection zone 108. In certain embodiments of the invention described herein, the antennas provided in pedestals 102*a*, 102*b* can be comprised of a resonant circuit which includes an exciter coil in the form of a conventional conductive wire loop. Antennas of this type are commonly used in AM type EAS pedestals. In some embodiments, a single antenna can be used in each pedestal and the single antenna is selectively coupled to the EAS receiver and the EAS transmitter in a time multiplexed manner. However, it can be advantageous in some scenarios to include two antennas in each pedestal as shown, with an upper antenna positioned above a lower antenna.

The antennas located in the pedestals 102*a*, 102*b* are electrically coupled to a system controller 110, which controls the operation of the EAS detection system to perform EAS functions as described herein. The system controller can be located within a separate chassis at a location spaced apart from the pedestals such that the controller is remote from the antenna. For example, the system controller 110 can be located in a ceiling just above or adjacent to the pedestals.

EAS detection systems are well known in the art and therefore will not be described here in detail. However, a brief description of the operation of such systems will be provided as an aid to understanding the inventive arrangements. An antenna of an acousto-magnetic (AM) type EAS detection system is used to generate an electro-magnetic field which serves as a marker tag exciter signal. The marker tag exciter signal causes a mechanical oscillation of a strip (e.g. a strip formed of a magnetostrictive, or ferromagnetic amorphous metal) contained in a marker tag within a detection zone 108. As a result of the stimulus signal, the tag will resonate and mechanically vibrate due to the effects of magnetostriction. This vibration will continue for a brief time after the stimulus signal is terminated. The vibration of the strip causes variations in its magnetic field, which can induce an AC signal in the receiver antenna. This induced signal is used to indicate a presence of the strip within the detection zone 108.

Figure 4:
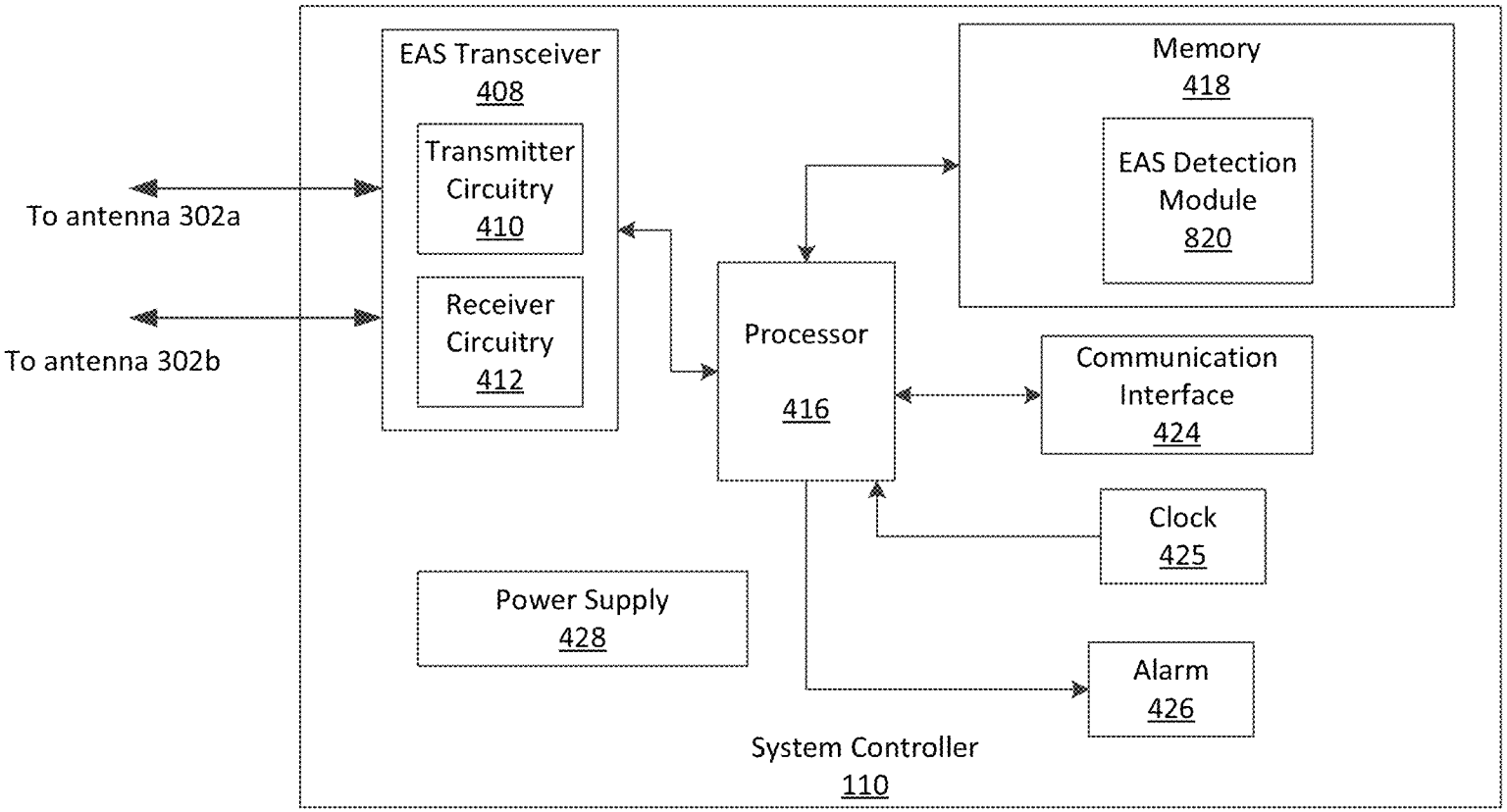
FIG. 4 is a block diagram of an EAS system controller, including an EAS transceiver.

Referring now to FIG. 4, there is provided a block diagram that is useful for understanding the arrangement of the system controller 110. The system controller comprises a processor 416 (such as a micro-controller or central processing unit (CPU)). The system controller also includes a computer readable storage medium, such as memory 418 on which is stored one or more sets of instructions (e.g., software code) configured to implement one or more of the methodologies, procedures or functions of an EAS system. The instructions (i.e., computer software) can include an EAS detection module 420 to facilitate EAS detection of marker tags. These instructions can also reside, completely or at least partially, within the processor 416 during execution thereof.

The system also includes at least one EAS transceiver 408, including transmitter circuitry 410 and receiver circuitry 412. The transmitter and receiver circuitry are electrically coupled to antenna 302*a* and/or the antenna 302*b*. A suitable multiplexing arrangement can be provided to facilitate both receive and transmit operation using a single antenna (e.g. antenna 302*a* or 302*b*). Transmit operations can occur concurrently at antennas 302*a*, 302*b* after which receive operations can occur concurrently at each antenna to listen for marker tags which have been excited. Alternatively, transmit operations can be selectively controlled so that only one antenna is active at a time for transmitting marker tag exciter signals. Input exciter signals are applied to the one or more antennas by transmitter circuitry (transmitter) 410.

Additional components of the system controller 110 can include a communication interface 424 configured to facilitate wired and/or wireless communications from the system controller 110 to a remotely located EAS system server. The system controller can also include a real-time clock, which is used for timing purposes, an alarm 426 (e.g. an audible alarm, a visual alarm, or both) which can be activated when an active marker tag is detected within the EAS detection zone 108. A power supply 428 provides necessary electrical power to the various components of the system controller 110. The electrical connections from the power supply to the various system components are omitted in FIG. 4 so as to avoid obscuring the invention.

Those skilled in the art will appreciate that the system controller architecture illustrated in FIG. 4 represents one possible example of a system architecture that can be used with the present invention. However, the invention is not limited in this regard and any other suitable architecture can be used in each case without limitation. Dedicated hardware implementations including, but not limited to, application-specific integrated circuits, programmable logic arrays, and other hardware devices can likewise be constructed to implement the methods described herein.

Figure 5A:
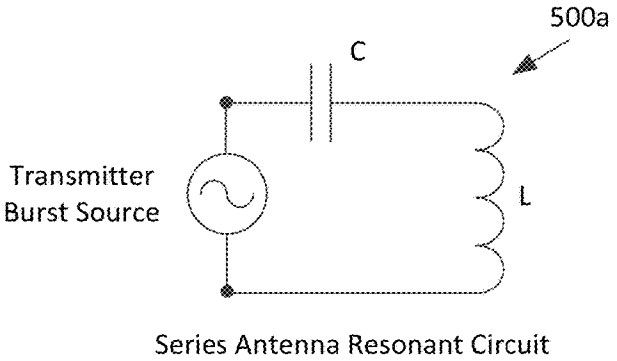
FIGS. 5A-5C show several different types of resonant circuits that can be used as part of an EAS exciter system.
Figure 5B:
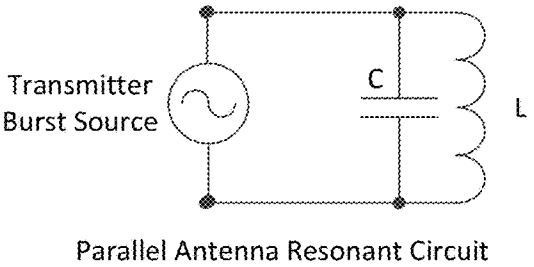
Figure 5C:
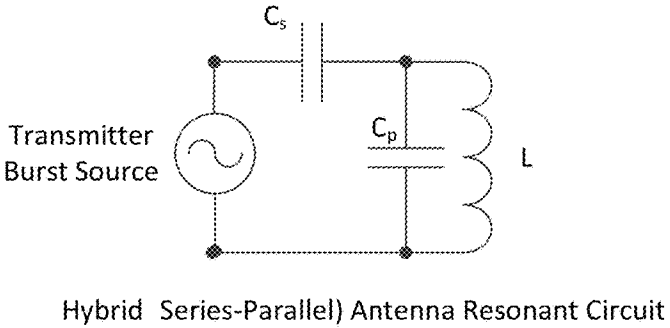

An antenna 302*a*, 302*b* is comprised of a resonant circuit. As such, the antenna will include an inductive component L and a capacitive element C. The inductive element is generally provided in the form on an exciter coil similar to that which is shown in FIG. 3. The exciter coil can be comprised of a plurality of loops of conductive wire which are coiled around a dielectric form. The exciter coil and the capacitive element are selected to provide a desired resonant frequency suitable for exciting an EAS tag. Referring now to FIG. 5A a resonant circuit used with the present invention can include a series resonant circuit 500*a* which includes a capacitor C and an inductor (exciter coil) L. The resonant circuit is excited by a transmitter burst source as described above. In an alternative embodiment, an antenna 302*a*, 302*b* can be comprised of a parallel resonant circuit 500*b*, which similarly includes a capacitor C and an inductor (exciter coil) L. As a further alternative, an antenna can be comprised of a hybrid (series-parallel) resonant circuit. The hybrid resonant circuit can include a series capacitor $C_s$, a parallel capacitor $C_p$ and an inductor (exciter coil) L.

It will be appreciated by those skilled in the art that the quality factor or Q factor of a resonant circuit is a dimensionless parameter that is used to characterize the amount of damping in a resonant circuit. Methods for calculating Q factor are well known in the art and therefore will not be described here in detail. In general however, higher Q indicates less dissipation (less damping) of energy occurs in a resonant circuit, and lower Q indicates more dissipation (more damping) of energy in the circuit. As is known in the art, energy dissipation in a resonant circuit is generally due to dissipative elements in the form of resistance or ohmic losses in the circuit.

Figure 6:
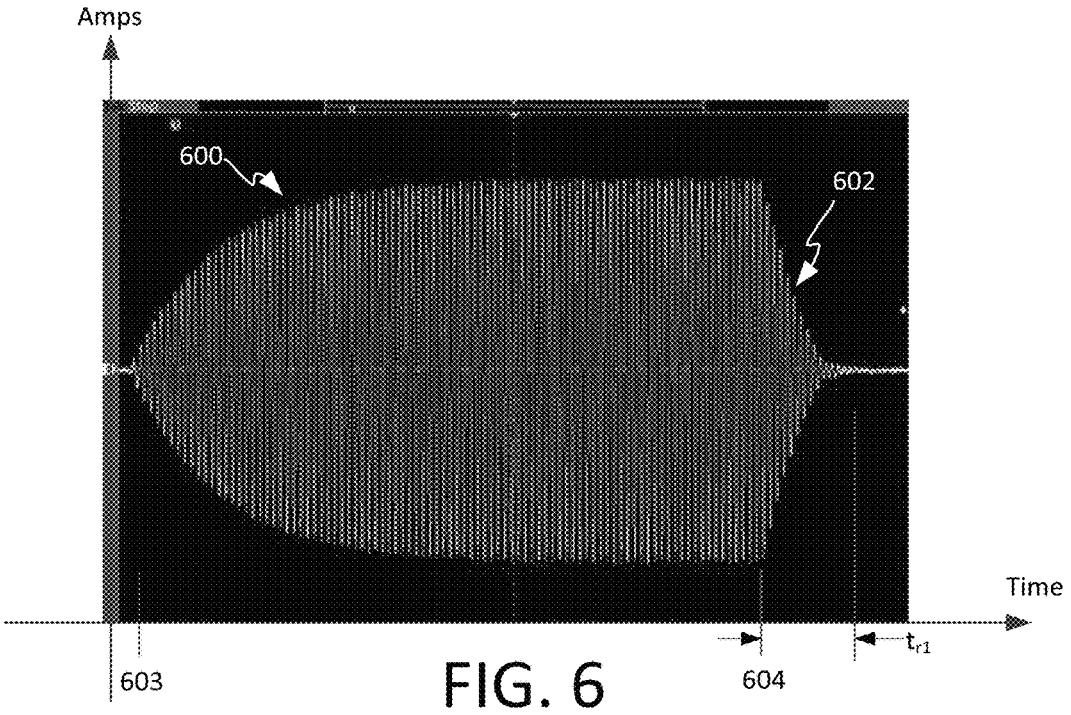
FIG. 6 shows an exemplary burst of electromagnetic energy that can be used to excite a marker tag in an EAS system, with a relatively long ring-down period.

During the time when an antenna resonant circuit is actually being excited in an EAS system it is desirable for the resonant circuit to have a high Q factor for greater efficiency. But resonators with high quality factors have low damping so that they ring for a longer period after a source of energy is removed at an end time. The ringing effect 602 is apparent in FIG. 6 which shows that an alternating current exciter signal burst as generated by an EAS transmitter will have a start time 603 and an end time 604. When the exciter pulse is applied to an under-damped resonant circuit as shown in FIG. 6, the current oscillations of the alternating current exciter signal burst 600 will have a ring time $t_{r1}$ during which the oscillations diminish slowly over time following exciter pulse end time 604. This ringing effect can make EAS tags more difficult to detect under certain scenarios.

Figure 7:
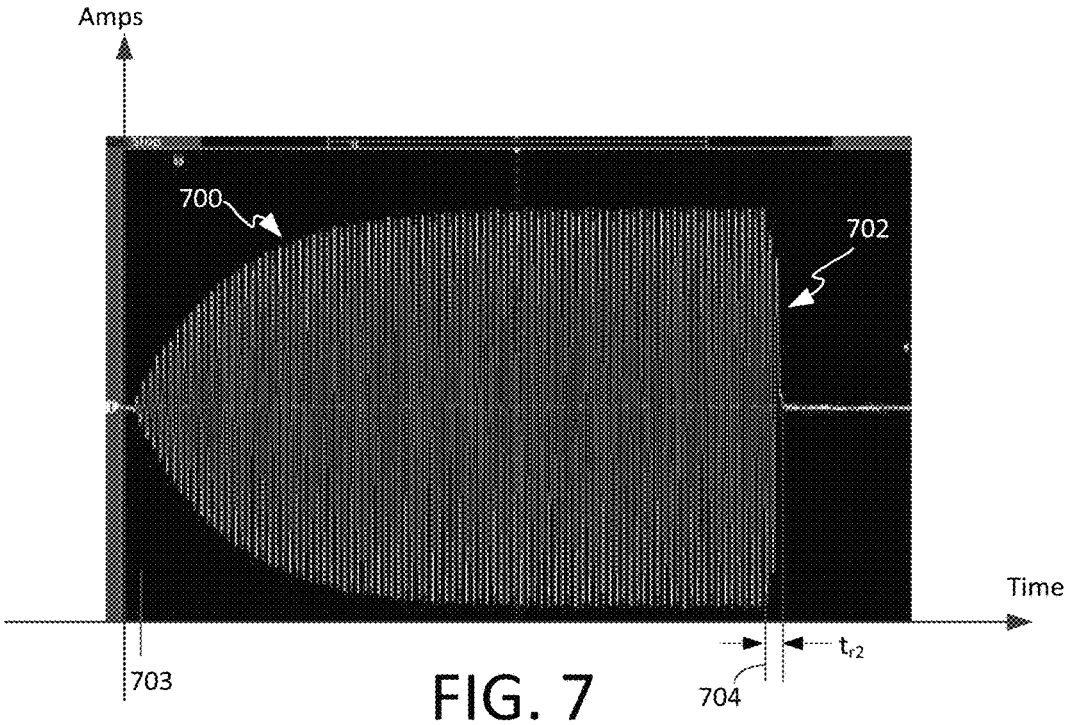
FIG. 7 shows an exemplary burst of electromagnetic energy that can be used to excite a marker tag in an EAS system where the period of time for ring-down is reduced.

Referring now to FIG. 7, an exciter signal 700 applied to a resonant circuit with greater amounts of damping will have a faster ring-down 702 (less ringing) after termination of the exciter signal burst is terminated at end time 704. But increased damping will make the circuit less efficient if applied for the entire duration of the burst. Accordingly, it is advantageous to automatically selectively increase damping only at a time 704 corresponding to the end of the burst. This selective increase in damping reduces the ring down time, without adversely effecting circuit efficiency.

FIG. 7 shows a burst signal 700 applied to the same resonant circuit in FIG. 6, but with automatic damping applied at the end of the burst. It can be observed that the ring down 702 in FIG. 7 occurs more rapidly as compared to the ring-down in period 6. In particular, the ring-down time in FIG. 7 is $t_{r2}$, which is of much shorter duration as compared to $t_{r1}$. As is known in the art, an EAS exciter signal can be comprised of a plurality of exciter signal bursts 600, 700 periodically spaced in time.

An automatic damping circuit for a series resonant circuit that is provided remotely (e.g. at a burst source, or at the control system 110) can provide a limited amount of damping. But parasitic reactance present in the wiring between the transmitter and the antenna will inherently limit the effectiveness of such damping. This is because the dissipative or resistive element added to the circuit at the control system for damping purposes is physically remote from the exciter coil of the resonant circuit. Still, it has been found that an acceptable amount of damping effectiveness is still obtained when an antenna utilizes a series resonant circuit with a remotely located damping circuit. In contrast, it has been found that a damping circuit for a parallel resonant circuit that is provided remotely from an antenna will have little or no damping effect at all. The parasitic reactance in the circuitry between the antenna and the damping circuit is sufficient to substantially limit the interaction of the remote damping circuit with the parallel resonant circuit. As such, a remote damping circuit for an antenna utilizing a parallel resonant circuit has been found to have little or no effectiveness at reducing ringing. Similarly, a remotely located damping circuit for a hybrid antenna resonant circuit has been found to have little or no effectiveness at reducing a ringing effect. From the foregoing it will be understood that arrangements which facilitate automatic damping directly at the antenna are particularly advantageous for use in systems that utilize parallel or hybrid resonant circuits. Moreover, for all three types of resonant circuits, it has been found that the most effective way to reduce the ring-down time is by placing a switched dissipative element (e.g. a resistor) in parallel with the exciter coil. For maximum effectiveness, the switched dissipative element should be connected in parallel directly or in very close proximity to the exciter coil.

Figure 8:
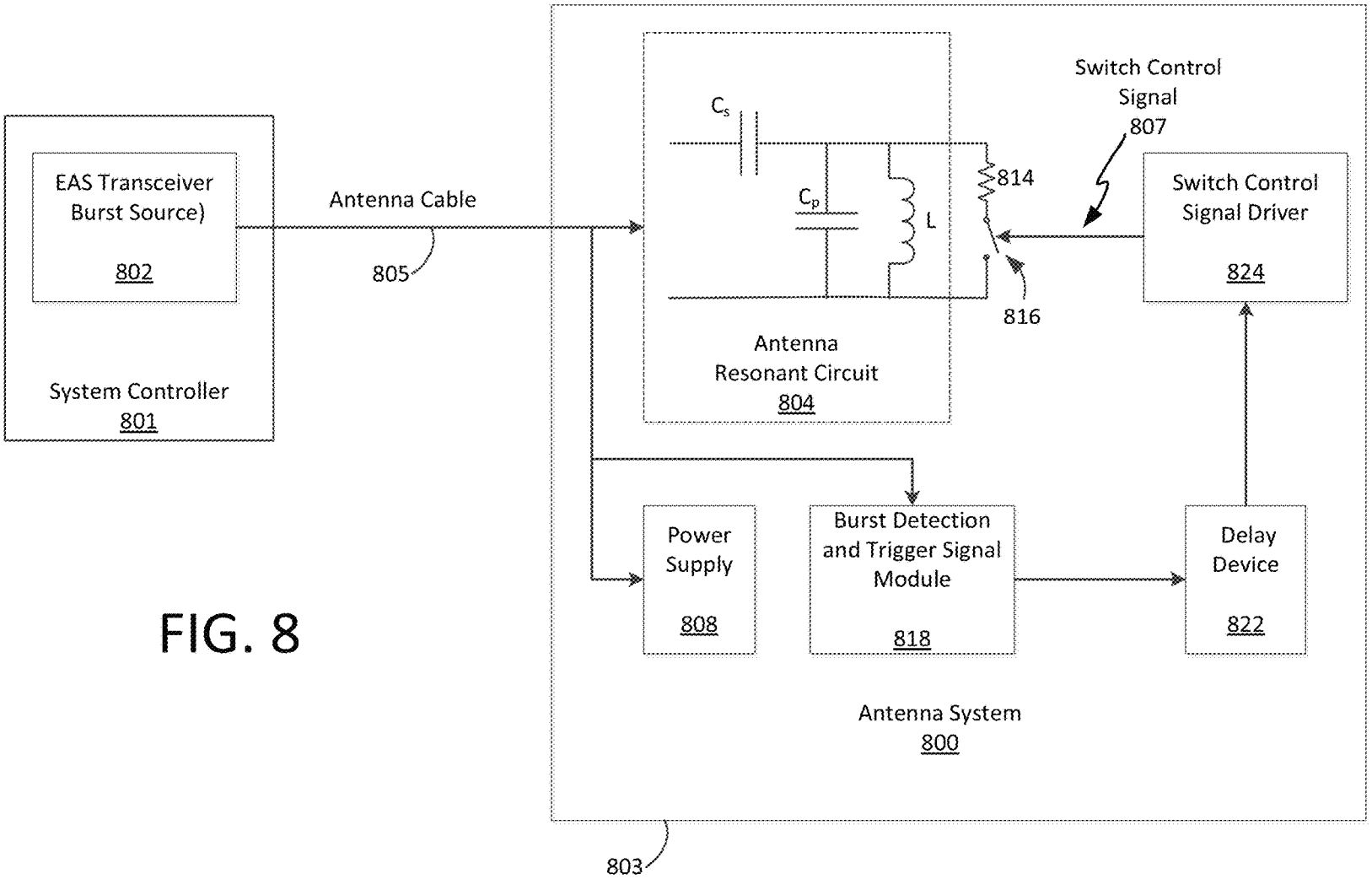
FIG. 8 is a block diagram that is useful for understanding an EAS system in which damping operations are performed remotely from an EAS exciter signal source, and without the need for additional circuitry between the EAS system controller and the resonant antenna system.

Referring now to FIG. 8, there is shown an EAS system for automatically damping a resonant antenna directly at the location of the antenna resonant circuit, and without the need for control signals supplied from a remote EAS transmitter 802 or EAS system controller 801. The absence of any need for control signals means that the automatic damping systems described herein can advantageously be retrofit into systems where the EAS system controller 801 does not generate control signals to facilitate automatic damping. The inventive arrangements include an antenna resonant circuit with a high Q factor, where a damping circuit located at the resonant circuit automatically increases the damping (lowers the Q factor) at the end of an exciter signal burst so as to reduce ring time.

In the exemplary arrangement shown in FIG. 8, an antenna system 800 includes an antenna resonant circuit 804 disposed in an antenna system housing 803. The antenna system 800 is remote from an EAS system controller 801 and an EAS transceiver 802. The antenna system housing 803 can comprise an antenna pedestal (such as pedestal 102*a*, 102*b*); but the invention is not limited in this regard. For example, the antenna housing 803 may also be comprised of a recess or compartment containing the antenna resonant circuit and disposed in a floor, wall or ceiling that is adjacent to an EAS detection zone. Also present at or within the antenna housing 803 is an automatic antenna resonant circuit damping system. The damping system is part of the antenna system 800 and is arranged to automatically selectively perform damping of the antenna resonant circuit 804 directly at the location of such resonant circuit. According to one aspect of the invention, the damping system facilitates selective connection of a dissipative element (e.g. resistor 814) directly to the antenna resonant circuit (e.g directly to the exciter coil), without any lengthy intervening cables or wiring.

Figure 10:
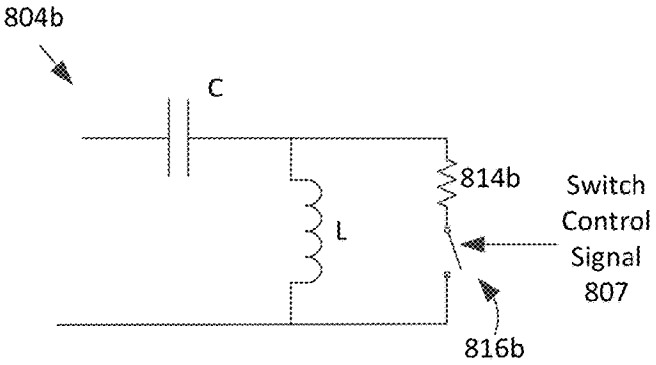
FIG. 10 shows an exemplary switching device and dissipative element in a series resonant antenna circuit.
Figure 9:
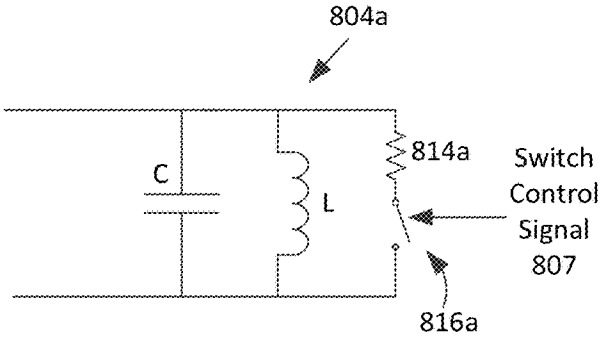
FIG. 9 shows an exemplary switching device and dissipative element in a parallel resonant antenna circuit.

In the exemplary embodiment shown in FIG. 8, the antenna resonant circuit 804 is comprised of a hybrid (series-parallel) type resonant circuit which includes a series capacitor $C_s$, a parallel capacitor $C_p$ and an inductor or exciter coil L. A resistor 814 and an electronically controlled switching element 816 are provided for selective damping of the antenna resonant circuit 804. The switching element 816 is disposed in an open circuit configuration when the exciter signal burst is being applied so that no current will flow through resistor 814 during that time. Accordingly, the antenna resonant circuit will be un-damped while the exciter signal is applied and will have a relatively high quality factor or Q factor. At the end of the exciter signal burst, damping system control circuitry described below will generate a switch control signal 807 to automatically control (close) switching element 816 to allow current to flow through the resistor 814. The resistor will serve to increase damping in antenna resonant circuit 804 so that the Q of the resonant circuit will be automatically reduced. A similar arrangement can be used for other types of antenna resonant circuits. For example, FIG. 9 shows a parallel antenna resonant circuit with the selectively controlled damping circuit comprised of resistor 814*a* and switch 816*a* in which the switch is closed to increase damping (reduce Q factor). FIG. 10 shows a series type antenna resonant circuit in which the selectively controlled damping circuit is comprised of resistor 814*b* and switch 816*b* in which the switch is closed to increase damping (reduce Q factor).

As shown in FIG. 8, an exemplary damping control system includes a burst detection and trigger signal module 818, a delay device 822, and a switch control signal driver circuit 824. The exact arrangement of the foregoing modules is not critical provided that the switch control signal driver circuitry 824 generates a signal to temporarily control switching element 816 at the appropriate time. In particular, the switching element should be controlled to increase damping of the antenna resonant circuit at an end of each exciter pulse. In the example shown, the burst detection and trigger signal module 818 detects the beginning of an exciter signal burst and sends a trigger signal to delay device 822. The delay device delays the trigger signal by a predetermined period of time corresponding to the known length of the exciter signal burst (e.g. 1.6 mS). After this delay time, the trigger signal is communicated from the delay device to the switch control signal driver circuitry 824 to generate the necessary switch control signal 807 for a short period of time at the end of the burst. The switch control signal 807 actuates the switching element 816 for a brief period of time during ring-down of the exciter signal burst. The exact amount of time that the switching element is activated for reduced Q is not critical provided that the additional damping should be removed before the next exciter signal burst is received at the antenna. As an example, the switching element could be activated for a period of 100 μS at the end of each exciter signal burst.

In some scenarios, the only connection between the EAS system controller 801 and the antenna housing 803 will be the antenna cable 805 which couples the EAS transceiver to the antenna resonant circuit. In such systems, there is no readily available primary power source available at the antenna housing that can be used for powering the automatic damping circuits described herein. It is desirable to avoid making modifications to an existing system controller and antenna cable when retrofitting such existing systems with an antenna-based automatic damping system. Accordingly, a power supply 808 can be provided for the damping control system at the antenna housing 803, remote from both the system controller 801 and EAS transceiver 802. According to one aspect of the invention, the power supply can derive power for the automatic damping system from the exciter signal burst.

Figure 11:
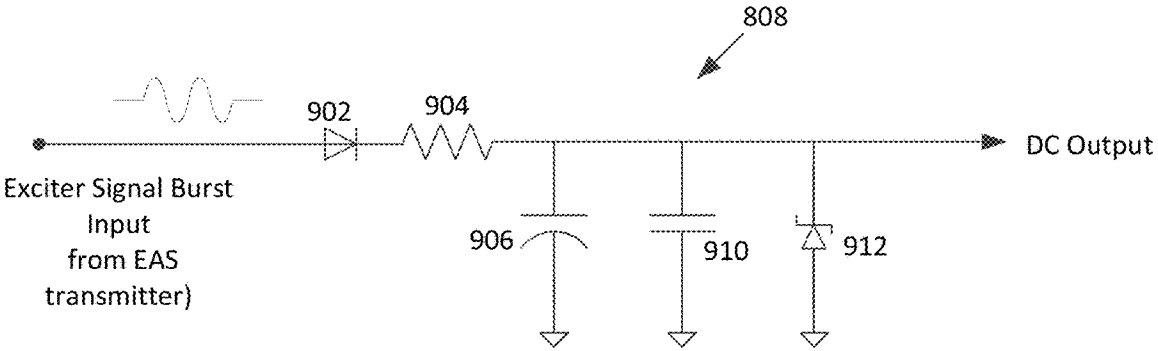
FIG. 11 shows an exemplary arrangement of a power supply which can be used to derive power from periodic bursts of AC voltage associated with an exciter signal.

A detailed drawing of an exemplary power supply 808 for the automatic damping system is shown in FIG. 11. The power supply converts a portion of periodic exciter signal burst from an EAS transmitter to a primary power supply voltage that is suitable for powering the automatic damping control circuitry at the antenna housing. For example, in an AM type EAS system the exciter signal comprises an AC waveform comprised of periodic 1.6 millisecond (mS) bursts at a carrier frequency of 58 KHz. In such a scenario, a power supply 808 can include a rectifier 902 to convert the AC waveform to pulsed DC, one or more capacitors 906, 910 to smooth or filter the pulsed DC signal and a voltage regulating device 912, such as a zener diode. In order to avoid obscuring the invention, connections between the power supply 808 and the various components of the automatic damping control system are not shown. However, it will be appreciated that an output voltage from power supply 808 can be coupled to one or more of the elements comprising the damping control system 818, 822, and 824.

The arrangement shown in FIG. 8 depicts an antenna system 800 in which only a single antenna resonant circuit 804 is provided. However, as noted above with respect to FIG. 1-3, certain types of EAS antenna systems may include two separate exciter coils which can be independently excited. For example two exciter coils can be disposed in a single antenna pedestal. In such scenarios, a separate automatic damping system as shown and described herein can be provided for each antenna resonant circuit. Alternatively, depending on the exact configuration of the exciter coils and the manner in which they are used in a particular EAS system, one or more of the components or modules comprising the automatic damping system may be shared between the two damping systems so as to avoid unnecessary duplication of components.

Figure 12:
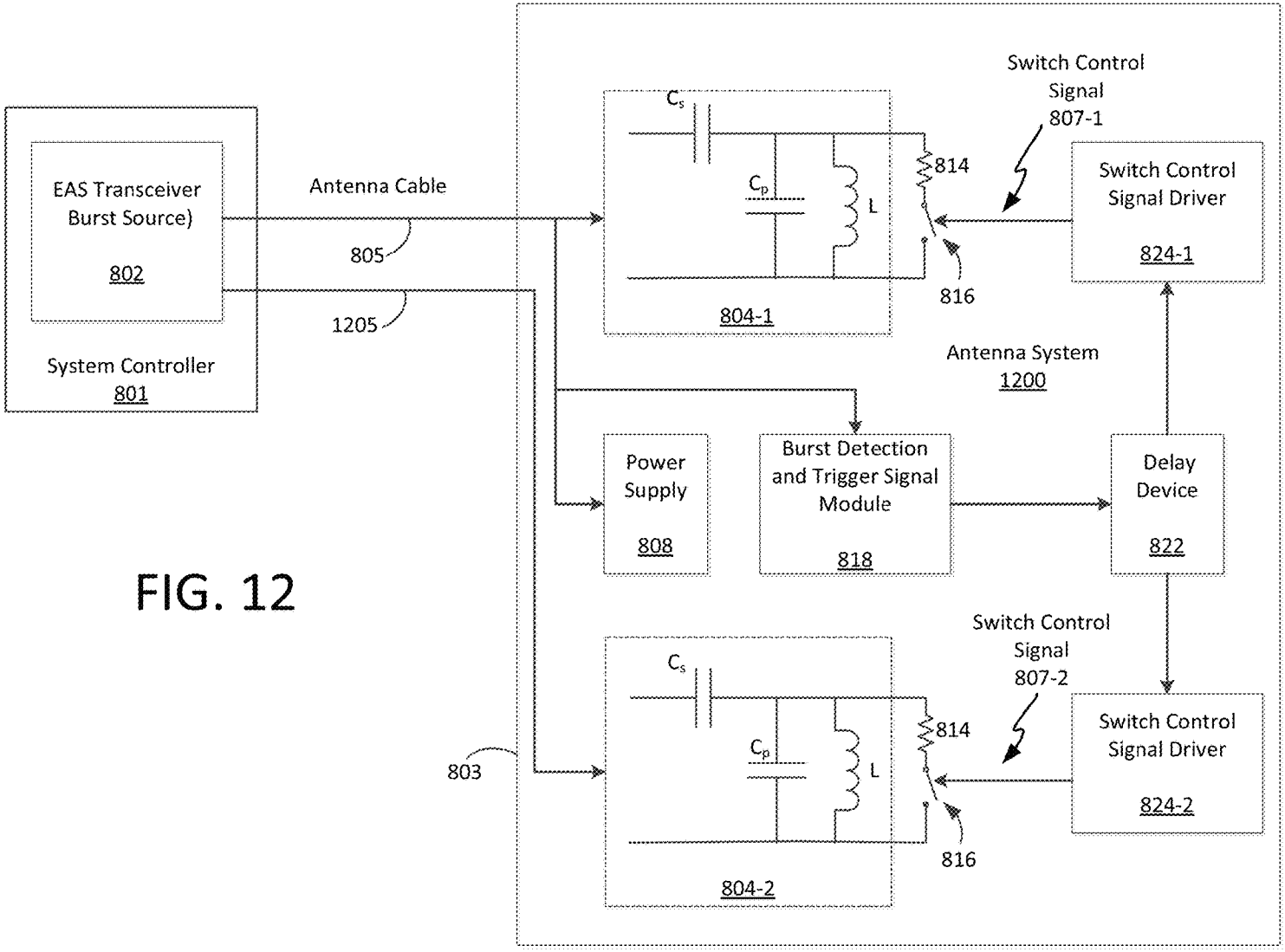
FIG. 12 is a block diagram that is useful for understanding an EAS system with automatic damping where dual exciter coils are provided in one antenna system.

Referring now to FIG. 12 there is shown an exemplary arrangement of an antenna system 1200 which is similar to the one described above in relation to FIG. 8, but includes two antenna resonant circuits 804 rather than one. Exciter bursts are communicated separately to each of the antenna resonant circuits using antenna cables 805, 1205. If the EAS system is arranged to excite both antenna resonant circuits simultaneously, then a single automatic damping system can be used to selectively control damping in both antenna resonant circuits. In such a scenario, the automatic damping system can include a burst detection and trigger signal module 818, and a delay device 822 similar to the modules described above in relation to FIG. 8. The burst detection and trigger signal module 818, and delay device 822 can be arranged as shown in FIG. 12 so as to derive timing information from exciter bursts communicated to the antenna system on one antenna cable (e.g. antenna cable 805).

Two separate switch control signal drivers 824-1 and 824-2 each receive trigger signals from the delay device 822. The switch control drivers 824-1, 824-2 respectively generate switch control signals 807-1, 807-2 to simultaneously control switches 816 respectively associated with antenna resonant circuits 804-1, 804-2. A single common power supply 808 can provide primary electrical power for all modules in antenna system 1200 by using a small portion of the electrical power contained in the exciter bursts and communicated to the antenna system by one antenna cable (e.g. antenna cable 805). A single set of burst detection and delay modules (818, 822) are acceptable in such a scenario provided that exciter signal bursts received on antenna line 1205 have the same timing as those received on antenna line 805.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

What is claimed is:

1. An Electronic Article Surveillance (EAS) resonant antenna system with self-contained automatic selective damping, comprising:

an antenna resonant circuit responsive to an exciter signal produced by a remotely located EAS transceiver, the exciter signal comprised of a-periodic bursts of alternating current (AC) electrical energy which, when applied to the antenna resonant circuit, produce an electromagnetic field for exciting an EAS marker tag; and a damping control system provided at the location of the antenna resonant circuit, remote from the EAS transceiver;

wherein the damping control system comprises a burst detection module that detects each said periodic burst received at the antenna resonant circuit, and a switch control signal driver that controls a switch in response to said burst detection module's detection of said periodic burst; and wherein the switch is actuated during a period of time at an end of said periodic burst.

2. The EAS resonant antenna system according to claim 1, wherein said damping control system initiates a timing trigger signal for decreasing the Q factor based exclusively on said periodic burst received at the antenna resonant circuit, absent any other control signal from the EAS transceiver or other remote circuitry.

3. The EAS resonant antenna system according to claim 1, further comprising a switching element and a dissipative element provided at the location of the antenna resonant circuit, wherein the switching element connects said dissipative element to the antenna resonant circuit at said predetermined time to decrease the Q factor.

4. The EAS resonant antenna system according to claim 1, wherein the predetermined time is chosen to reduce ringing at a trailing edge of each burst of said exciter signal.

5. The EAS resonant antenna system according to claim 4, wherein the damping control system automatically restores the Q factor of the antenna resonant circuit to a higher Q factor value before a next periodic burst is received.

6. The EAS resonant antenna system according to claim 4, wherein the damping control system detects a beginning of each said periodic burst and in response thereto generates a switch control signal after a predetermined delay to selectively decrease the Q factor.

7. The EAS resonant antenna system according to claim 6, wherein the predetermined delay corresponds to a predetermined duration of each said periodic burst.

8. An Electronic Article Surveillance (EAS) system comprising:

an EAS system controller including an EAS transceiver; and a resonant antenna system located remote from the EAS system controller and coupled to the EAS system controller through an antenna cable, the resonant antenna system comprising:

an antenna resonant circuit responsive to an exciter signal produced by the EAS transceiver, the exciter signal comprised of a periodic burst of alternating current (AC) electrical energy which, when applied to the antenna resonant circuit, produce an electromagnetic field for exciting an EAS marker tag; and a damping control system provided at the location of the antenna resonant circuit, remote from the EAS transceiver;

wherein the damping control system comprises a burst detection module that detects each said periodic burst received at the antenna resonant circuit, and a switch control signal driver that controls a switch in response to said burst detection module's detection of said periodic burst.

9. The EAS system according to claim 8, wherein said damping control system initiates a timing trigger signal for decreasing the Q factor based exclusively on said periodic burst received at the antenna resonant circuit, absent any other control signal from the EAS system controller.

10. The EAS system according to claim 8, further comprising a switching element and a dissipative element provided at the location of the antenna resonant circuit, wherein the switching element connects said dissipative element to the antenna resonant circuit at said predetermined time to decrease the Q factor.

11. The EAS system according to claim 8, wherein the predetermined time is chosen to reduce ringing at a trailing edge of said exciter signal.

12. The EAS system according to claim 11, wherein the damping control system automatically restores the Q factor of the antenna resonant circuit to a higher Q factor value before a next periodic burst is received.

13. The EAS system according to claim 11, wherein the damping control system detects a beginning of each said periodic burst and in response thereto generates a switch control signal after a predetermined delay to selectively decrease the Q factor.

14. The EAS system according to claim 13, wherein the predetermined delay corresponds to a predetermined duration of each said periodic burst.

15. A method for selectively controlling a Q-factor of an antenna resonant circuit in an EAS system, comprising:

using a burst detection module of a damping control system disposed at a location of an antenna resonant circuit to detect an exciter signal produced by a remotely located EAS transmitter, the exciter signal comprised of periodic bursts of alternating current (AC) electrical energy which, when applied to the antenna resonant circuit, produce an electromagnetic field for of exciting an EAS marker tag;

responsive to said burst detection module's detection of the exciter signal, operating a switch control signal driver of said damping control system to generate a switch control signal;

using said switch control signal to control a switch; and using the damping control system to control a timing of said switch control signal so as to reduce a Q factor at a predetermined time selected to reduce ringing at a trailing edge of each said periodic burst.

* * * * *